US007394386B2

(12) United States Patent
Nowlan

(10) Patent No.: US 7,394,386 B2
(45) Date of Patent: Jul. 1, 2008

(54) LOCATION SIGNALING FOR TRANSPORT SYSTEM

(75) Inventor: Steven J. Nowlan, South Barrington, IL (US)

(73) Assignee: Motorola, Inc., Schaumburg, IL (US)

( * ) Notice: Subject to any disclaimer, the term of this patent is extended or adjusted under 35 U.S.C. 154(b) by 152 days.

(21) Appl. No.: 11/072,569

(22) Filed: Mar. 3, 2005

(65) Prior Publication Data

US 2006/0208878 A1 Sep. 21, 2006

(51) Int. Cl.
*G08B 23/00* (2006.01)

(52) U.S. Cl. ..... 340/573.1; 340/573.4; 340/574; 340/539.13; 340/539.15; 340/539.22; 455/404.2

(58) Field of Classification Search ..... 340/573.1, 340/573.4, 574, 539.13, 539.15, 539.22; 455/404.2

See application file for complete search history.

(56) References Cited

U.S. PATENT DOCUMENTS

| | | | | |
|---|---|---|---|---|
| 5,485,163 | A | 1/1996 | Singer et al. | |
| 5,801,627 | A | 9/1998 | Hartung | |
| 5,825,283 | A | 10/1998 | Camhi | |
| 6,031,460 | A | 2/2000 | Banks | |
| 6,563,427 | B2 | 5/2003 | Bero et al. | |
| 7,015,817 | B2 * | 3/2006 | Copley et al. | 340/573.4 |
| 7,181,620 | B1 | 2/2007 | Hur | |
| 2001/0018663 | A1 | 8/2001 | Dussell et al. | |
| 2001/0026240 | A1 * | 10/2001 | Neher | 342/357.07 |
| 2002/0120703 | A1 | 8/2002 | Kaufman et al. | |
| 2003/0218539 | A1 * | 11/2003 | Hight | 340/539.13 |
| 2004/0080421 | A1 | 4/2004 | Wunderlich | |
| 2004/0085207 | A1 | 5/2004 | Kreiner et al. | |
| 2005/0083195 | A1 * | 4/2005 | Pham et al. | 340/539.13 |

FOREIGN PATENT DOCUMENTS

EP 1 008 946 A1 6/2000

OTHER PUBLICATIONS

Wherify Wireless, GPS Locator For Children, http://www.wherifywireless.com/prod_watches.htm, pp. 1-4.
Wherify Wireless, Wherify's GPS Locator Phone, http://www.wherifywireless.com/univLoc.asp, pp. 1-2.
Wherify Wireless, Products Page, htt;://www.wherifywireless.com/products.htm, pp. 1-2.

* cited by examiner

*Primary Examiner*—Tai Nguyen
(74) *Attorney, Agent, or Firm*—Brian M. Mancini; Valerie M. Davis

(57) ABSTRACT

A system and method to provide location signaling for service, such as a request for transport from a child to his or her parent(s) to be picked up from school, for example. A dedicated communication device has location capabilities and a control to request service for the bearer. At least one monitoring communication device, such as one for each parent, is operable to receive a location with a request for service and acknowledge same. A secure domain manager can be used to; receive the location and request service instruction, deliver the location and request service instruction to the monitoring device(s), obtain an acknowledgment from one monitoring device, and send the acknowledgment to the other monitoring devices and the bearer's communication device. Communication is only allowed between the bearer's device and monitoring devices. The location of the communication device can be tracked, and navigation can be provided thereto.

17 Claims, 2 Drawing Sheets

LOCATION SIGNALING FOR TRANSPORT SYSTEM

FIELD OF THE INVENTION

The present invention relates generally to wireless location communication systems, and more particularly to a system for use in signaling a location of person for service.

BACKGROUND OF THE INVENTION

The recent explosion of wireless communication devices and applications lends itself to many uses besides basic communications. The predominant use of such devices has been to allow family and friends to keep in touch with each other. However, due to high monthly fees it has been uneconomical to provide such devices to small children. In addition, very small children would not be able to properly operate the typical cellular phone. However, it is of paramount concern to monitor children for their safety. Therefore, the solution has arisen to use wireless technology to satisfy the need to provide child location systems.

One prior art solution is to use the Global Positioning System (GPS) to provide location services. However, such service is typically incorporated within a communication device and generally does not provide interaction with external devices and services. Another prior art solution has been to install radio frequency (RF) tags, such as in a car for example, which can transmit a location of the car if it is stolen. Again the technology is expensive and requires a large transmitter power source, such as a car battery. In addition, special receivers and software are needed to detect the signal. Another prior art solution uses cellular technology to locate a control signal scan of a cellular device. However, this technique requires a high power source for the continuous multi-cell control signal scan and response transmissions thereto. All of the above suffer from high expense, being impractical, or being difficulty to use.

Other prior art solutions attempt to provide a relatively lower cost solution. One such solution provides similar communication devices between a guardian and a child operable on a cellular network. However, such devices require complicated addressing and timing schemes to avoid interference with similar local devices. Other solutions provide a transmitter beacon on a child, which is simple, and a directional receiver with a location display for the parent. However, the directional receiver requires special hardware and constant monitoring of the parent. This simplistic method is little better than the parent keeping a constant eye on the child, which is still the method used most frequently today. Still another solution provides a customized system that provides a bracelet transceiver for the child and a monitor transceiver for a parent, wherein the parent can signal the bracelet to let the child know to return to the parent. However, this system is not autonomous and requires a positive action on the part of the parent to provide a system activation signal.

Accordingly, there is a need for an improved method and system which permits secure signaling of location information wirelessly to registered monitoring devices within a secure shared wireless domain, in order to request a service. It would also be of benefit to provide a way for one or more monitoring devices to signal that they will respond to the request for service, ensuring that everyone in the domain knows their responsibility in providing the service.

BRIEF DESCRIPTION OF THE DRAWINGS

The features of the present invention, which are believed to be novel, are set forth with particularity in the appended claims. The invention, together with further objects and advantages thereof, may best be understood by making reference to the following description, taken in conjunction with the accompanying drawings, in the several figures of which like reference numerals identify identical elements, wherein:

DETAILED DESCRIPTION OF THE PREFERRED EMBODIMENTS

Figure 1:
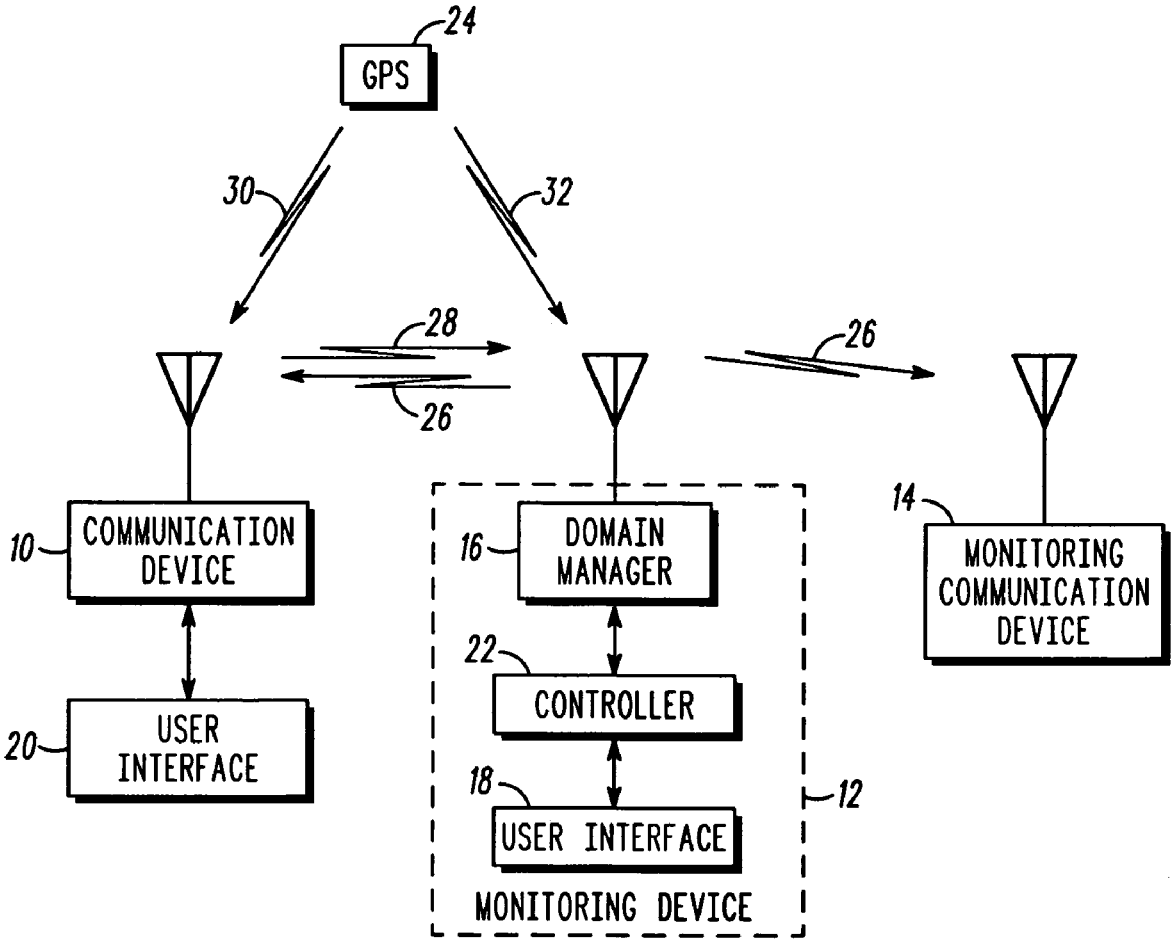
FIG. 1 shows a simplified schematic diagram of a location signaling system, in accordance with the present invention.

The present invention provides an improved method and system that permits secure signaling of location information wirelessly to registered monitoring devices within a secure shared wireless domain, in order to request a service such as transport for a child. The present invention also provides a way for one or more monitoring devices to signal that they will respond to the request for service, ensuring that everyone in the domain knows their responsibility in providing the service.

The present invention advantageously can be used in existing wireless radio communication networks. The present invention can be implemented on a very compact and cost effective way, by providing a dedicated specialty transceiver device, such as can be worn by a child, that communicates with a standard radio communication device, such as a parent's cellular telephone, for example. A secure domain is established to provide critical safety and security related communications and location information, but does not allow general purpose communication.

Often, the primary reason a parent will provide a child with a wireless communications device is for security reasons. The parent wants the child to be able to call them whenever they need them or whenever they need help or assistance. For the child, security is often not perceived as the main reason for having a wireless communications device. This can lead to issues of how to provide the security of a wireless communications device to a child, and also prevent or control undesired uses of that device. Many parents would prefer a device that could offer limited functionality for security reasons, but not allow other types of uses which may be less desired from the parent's perspective.

The main problem addressed here is how to provide a child with a very simple device which when queried provides the child's current location, and in addition allows the child to request a service such as being "picked-up". This request is sent automatically to both parents (and other enabled members within a "family domain"), and the entire system is organized to ensure that only a single (and generally the closest) responder is allowed to respond. The entire system must operate in a secure fashion so it cannot be "spoofed" or easily broken.

In a typical scenario, a child wears a small pendant or bracelet that includes location capabilities, such as a GPS system. This device has been entrained to wireless devices owned by both parents in a secure fashion. Either parent can send a wireless message to the device, and the device will return its current location in the form of GPS coordinates, which would be displayed as a map, address, or navigational information on the parent's wireless device. In addition, the device would have a dedicated activation button or switch. When pressed, this button would send a request for a pre-defined service for the child, such as to be picked up (i.e. from a play date, soccer practice, school event, etc.). This request would be received by all enabled wireless devices in the secure domain, and would be time stamped and also contain current location information.

Either parent could acknowledge the request. If the request was acknowledged by one device, all other devices would automatically be sent a notice indicating the request had been serviced. If multiple acknowledgements are received, the closest one would be confirmed as the acknowledger, and all other devices would again be sent a notice indicating the request had been serviced. The acknowledging device would then compute a route to the child devices location using either a device based or network based navigation application. Finally, when the parent arrives at the location (or a close enough proximity), the child's device would be sent a simple signal that the pickup had arrived (this could be a visual, auditory, or tactile alert for example).

Specific embodiments of the invention would allow for more or less sophisticated prioritization schemes, including for example not resolving the issue of multiple respondents directly. Also included would be embodiments where rather than a single button/message, the device would be capable of a small number of fixed and preprogrammed messages, hard coded to particular buttons or other activation methods. In addition, various aspects of the system, including multiple response resolution, could be handled in various locations including within the simple device, within the wireless network, within domain managers, or via additional communications between the more sophisticated parent devices. Embodiments could also omit time stamp information.

Referring to FIG. 1, the present invention a system consisting of a low cost, special purpose wireless radio frequency communication device 10 and associated infrastructure and wireless communications services and application software to permit specialized messages and location information to be sent from the device 10 to other devices 12, 14 registered within a secure domain for the purpose of querying the location of the bearer of the simple device 10 and allowing the bearer to send a signal 28 indicating a request for an action or service (typically a request to be picked up sent by a child to a parent), and enabling the responder 12 to navigate to the location of the child device 10.

There are a variety of ways in which such a system could be implemented, but all such systems would have the same basic elements. First, a low cost wireless radio communication device 10, such as a wearable bracelet for a child, is provided. The device 10 includes location capabilities for computing its location in some universal coordinate system. The location capabilities can utilize geo-stationary satellites, such as a GPS system 24 as shown, or can utilize any other location technique, such as through ground-based cellular network triangulation or time-of-arrival techniques for example, as are all known in the art. Combinations of these location technologies could also be used.

The communication device 10 will also include a simple user interface 20 that can include one or more specialized controls, such as switches or buttons. The user interface 20 has the capability to send and receive a specialized set of communications. In the simplest embodiment, a control can be provided on the user interface that, when activated by the bearer of the device (e.g. a child) for example, will transmit a pre-stored message 28 requesting a particular service or action, such as a request for transportation by a parent or guardian. The location of the device, as determined by the location capability of the device 10 will also be transmitted. The pre-stored message can be embedded in firmware of a dedicated device 10 or can be programmed therein. In its most basic form, the device 10 is restricted to only being able to request transport, provide its location, and to receive acknowledgment. Preferably, other controls can be provided on the user interface 20 for other dedicated services having pre-stored messages associated therewith. In addition, an emergency control or button can be provided for E911 services. The user interface 20 is also operable to receive communications that can be presented to the bearer in audio, visual, or tactile form, as will be detailed below.

At least one monitoring communication device 12, 14 is provided. Preferably, the monitoring device is a fully functioning communication device, such as a cellular radio telephone for example. Typically, the monitoring device is an existing cellular telephone of a parent or guardian of the child. It should be noted, however, that any other communication device, such as a PDA, computer, pager, and the like can be used equally well in the present invention. The monitoring device 12, 14 is operable to receive a location with a request for service (e.g. transport) transmitted by the child's device. The monitoring device 12, 14 is also operable to acknowledge the request to be received by the child's device 10.

In order to provide a secure and safe communication environment for the child, a secure encrypted messaging system would allow only devices registered as part of a group of devices (i.e. a "family domain") to communicate with the "child device" in a unique secure domain wherein secure forms of communication are only possible for devices within the domain. Therefore, a secure domain manager 16 is utilized to control communications. The domain manager 16 can be incorporated as hardware and an application on one or more parent's (monitoring) device 12, 14 as shown, or could be provided remotely, as a service by a network operator for example. The domain manager would be the central control point for the registration of all devices 10, 12, 14 into a secure domain. The domain manager would also be responsible for the traffic flow of communications between devices. The communications are encrypted so that they could only be read and understood by the child device 10 or another monitoring device 14 in the domain. Introduction of devices within this domain ideally should require some form of close proximity or direct physical contact, or some form of shared secure key server communication to ensure that unwanted devices could not be added to the domain. Therefore, a public/private key encryption system can be used wherein a common key can be embedded in each device 10, 12, 14, or wherein keys can be programmed between the parent 12, 14 and child device 10. For maximal security, an encryption system with hardware dependent keys is preferable, as is known in the art. In addition it should be noted that the system could be implemented with multiple redundant domain controllers (such as either or both parents' cell phones).

In practice, the secure domain manager is operable to; receive a location and request for transport instruction 28 from the radio communication device 10, deliver the location and request for transport instruction to the at least one monitoring communication device 12 on a user interface 18 thereof, obtain an acknowledgment from one of the monitoring communication devices 12 on a user interface 18 thereof, and notify the other monitoring communication devices 14 and the radio communication device 10 of the acknowledgment 26. The user interface 20 of the radio communication device 10 is then operable to inform the bearer of the device that an acknowledgment has been received identifying the one monitoring device (12 or 14) that acknowledged the request for service (e.g. transport). Additionally, relevant information can be encapsulated in the acknowledgement 26 to the request such as an estimated time of arrival based on input from the user of the monitoring device 12, potentially augmented by information from a navigation application.

The simplest secure encrypted messaging scheme for the child device 10 allows it to communicate in only one of two ways: a) the device 10 can respond to a message received from a device 12, 14 within its registered secure domain by replying with a message sent back to the originating device. This response message would at a minimum contain the positional coordinates of the child device, and b) the device 10 can broadcast a message to all devices 12, 14 within its registered secure domain. This message would at a minimum contain the positional coordinates of the child device 10. The domain manager 16 can add a status flag indicating whether any acknowledgment has been provided by any other monitoring device 12, 14.

An arbitration scheme can be used by the domain manager 16 which would ensure that when a broadcast was received from the child device 10, it would be acknowledged and accepted by only one device 12, 14 in the family domain, and all other devices would receive a broadcast 26 message indicating that the request had been acknowledged. Preferably, an optimization algorithm can be used to augment the arbitration scheme to ensure that when multiple family domain devices 12, 14 respond to a request for service, the request is acknowledged and accepted by the closest located device in the family domain, with all other devices receiving a broadcast message 26 that the request had been acknowledged.

After acknowledgment, the acknowledging monitoring device (12 in the example shown) can be provided navigational information to the given location of the child device 10. The navigational information can be provided through the domain manager 16 or directly by the device 12. Application software for family domain devices can be incorporated in a controller 22 that would display the location of the child device on a map on the user interface 18 and compute a route to the child device from the current location of the family device. This application software could optionally provide turn by turn navigation and routing instructions for the calculated route. This application software could be device based, network based or a combination of both. Typically, such navigational information can be provided by systems known in the art using the start and stop points of the route, obtained through respective signals 32, 30 from a GPS system 24 or example. While a parent is travelling a determined route to the given location, the secure domain manager 16 is operable to periodically query the child device 10 as to its location to track it. Navigational information can be updated accordingly. Preferably, when the monitoring device 12 is within close proximity (i.e. less than 10 meters) to the child device 10, determined by the domain manager 16 using the location capabilities of both devices 10, 12, a signal can be provided to the user interface 18 of the monitoring device 12 indicating same. This signalling could be one or more of a visual, tactile, or auditory signal.

In the above examples, the network communications 26, 28 can be performed on the paging channels of the compatible cellular telephone protocol for cost effectiveness. For example, such messaging can be accomplished on a Short Messages Service (SMS) channel in a GSM (Global System for Mobile communication), as is known in the art. In practice, all network communication is carried out on a compatible cellular radiotelephone system. It is also envisioned that if a child's device 10 becomes lost or unable to respond, a last known location of the device is transmitted to the monitoring devices 12, 14.

Figure 2:
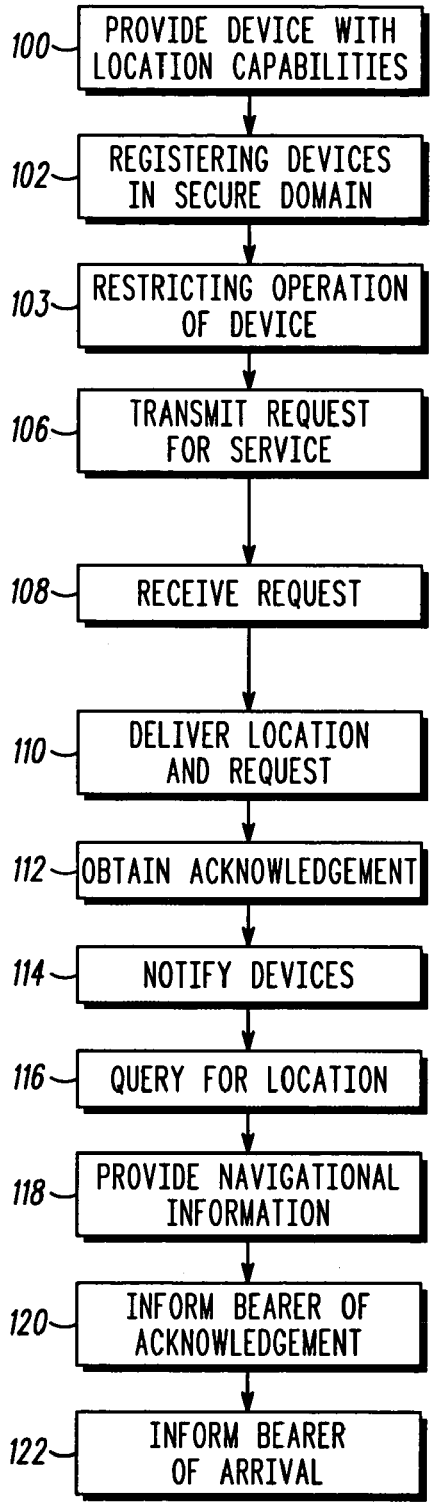
FIG. 2 shows a flow chart of a location signaling method, in accordance with the present invention.

As shown in FIG. 2, the present invention also provides a method for providing location signaling for service. The method includes a first step of providing 100 a wireless radio communication device having location capabilities and at least one monitoring communication device. The location capabilities can be any of those techniques known in the art, such as using GPS coordinates for example. For safety, the communication device and monitoring devices are registered 102 in a secure domain for using encrypted messages, as described previously, such that the method is only operable between the radio communication device and the at least one monitoring device. Preferably, the communication device is restricted 103 to only being able to request transport, provide its location, and to receive acknowledgment.

A next step includes transmitting 106 a location and request for service instruction from the radio communication device to the monitoring devices. This step can include transmitting a pre-recorded message for the requested service. The pre-stored message can be embedded in firmware of a communication device or can be programmed therein.

A next step includes receiving 108 the location and request service instruction. The request can be directly received by the monitoring communication devices, or can be received by an intermediate domain manager and delivered 110 to the monitoring communication devices, as described previously.

A next step includes sending 114 an acknowledgment from one of the monitoring communication devices to the other monitoring communication devices and the radio communication device, wherein the bearer of the communication device would be informed 120 of the acknowledgment identifying the one monitoring device that acknowledged the request for service.

The acknowledgment can sent directly by the acknowledging monitoring device or be obtained 112 by an intermediate domain manager which then notifies 114 the other monitoring device and the radio communication device.

To facilitate transport, navigational information can be provided 118 to the acknowledging monitoring device to provide a route to the communication device. Preferably, as the monitoring device travels to the communication device, the monitoring device can query 116 the radio communication device as to its location, and update the travel route as needed. Nearing arrival, when the monitoring device is within close proximity to the communication device, a signal can be provided to the monitoring device indicating same.

Different embodiments of the invention may use different types of wireless communications methods, different methods of sending and receiving messages, different message formats, etc. Further, the present invention could be used in conjunction with a number of different family oriented wireless service plans. The child device(s) could be provided for free as part of a monthly service plan for the "monitoring" of the child devices, including specialized application software that could be downloaded to handsets supplied with the wireless service plan. Alternatively, the simple devices themselves could be sold, bundled with application software which could be loaded onto handsets to enable the monitoring/communication with child devices. In addition, although described here in terms of a particular use case for parents and children, there are a number of similar potential use cases in the area of elder care, and certain types of specialized commercial services (e.g. a cleaning service that drops crews at locations and need to be notified when they are ready to be picked up).

Although the invention has been described and illustrated in the above description and drawings, it is understood that this description is by way of example only and that numerous changes and modifications can be made by those skilled in the art without departing from the broad scope of the invention. Although the present invention finds particular use in portable cellular radiotelephones, the invention could be applied to any communication device, including pagers, electronic organizers, and computers. The present invention should be limited only by the following claims.

What is claimed is:

1. A system to provide location signaling for a service, comprising:

a wireless radio communication device having location capabilities, and a user interface with a control to transmit a communication containing a request for service for a bearer of the wireless radio communication device; and at least one monitoring communication device, operable to receive the communication from the wireless radio communication device, receive a location of the wireless radio communication device, and send an acknowledgment to at least the wireless radio communication device, wherein the wireless radio communication device and the at least one monitoring communication device are registered at a secure domain manager, to facilitate encrypted communications between the wireless radio communication device and the at least one monitoring communication device.

2. The system of claim 1, wherein the requested service is for transport of the bearer of the wireless radio communication device.

3. The system of claim 1, wherein when the control of the user interface of the wireless radio communication device is activated, a pre-recorded communication for the requested service is transmitted to the at least one monitoring communication device.

4. The system of claim 1, wherein the at least one monitoring communication device is operable to query the wireless radio communication device as to its location.

5. The system of claim 1, wherein the at least one monitoring communication device is provided navigational information to the location of the wireless radio communication device.

6. The system of claim 1, wherein operation of the wireless radio communication device is restricted to only being able to request a service, provide its location, and receive acknowledgment.

7. The system of claim 1, wherein the user interface of the wireless radio communication device is operable to inform the bearer of the wireless radio communication device that an acknowledgment has been received identifying the at least one monitoring communication device that acknowledged the request for service.

8. The system of claim 1, further comprising a secure domain manager operable to receive the communication from the wireless radio communication device, deliver the communication to the at least one monitoring communication device, obtain an acknowledgment from the at least one monitoring communication device, and notify at least the wireless radio communication device of the acknowledgment; and wherein the at least one monitoring communication device receives the communication from the wireless radio communication device, receives the location of the wireless radio communication device, and sends an acknowledgment to at least the wireless radio communication device via the secure domain manager.

9. The system of claim 1 wherein the request for service is a request for transportation.

10. The system of claim 1 wherein the communication is a pre-recorded communication.

11. The system of claim 1 wherein the communication further contains the location of the wireless radio communication device.

12. A method for providing location signaling for a service, the method comprising the steps of:

providing a wireless radio communication device having location capabilities and at least one monitoring communication device;

transmitting a location and a request for service instruction from the wireless radio communication device;

receiving the location and the request for service instruction by the at least one monitoring communication device; and sending an acknowledgment from one of the monitoring communication devices to the wireless radio communication device, wherein the wireless radio communication device and the at least one monitoring communication device are registered at a secure domain manager, to facilitate encrypted communications between the wireless radio communication device and the at least one monitoring communication device.

13. The method of claim 12, wherein the transmitting step includes transmitting a pre-recorded communication for the requested service.

14. The method of claim 12, further comprising the step of querying the wireless radio communication device as to its location.

15. The method of claim 12, further comprising the step of providing navigational information to the location of the wireless radio communication device.

16. The method of claim 12, further comprising the step of restricting the operation of the wireless radio communication device to only being able to request service, provide its location, and to receive acknowledgment.

17. The method of claim 12, further comprising the step of informing the bearer of the device that an acknowledgment has been received identifying the at least one monitoring communication device that acknowledged the request for service.

* * * * *